United States Patent [19]

Rome et al.

[11] Patent Number: 4,941,716

[45] Date of Patent: Jul. 17, 1990

[54] CABINET CONSTRUCTION

[76] Inventors: Eugene P. Rome, 1730 N. 77th Ave., Elmwood Park, Ill. 60135; Carl P. Rome, 28 W. 172 Roosevelt, Winfield, Ill. 60190

[21] Appl. No.: 815,917

[22] Filed: Jan. 3, 1986

[51] Int. Cl.[5] ..... H47B 45/00

[52] U.S. Cl. ..... 312/205; 312/242

[58] Field of Search ..... 312/205, 242, 101; 248/27.1; 220/8.82 R

[56] References Cited

U.S. PATENT DOCUMENTS

| | | | |
|---|---|---|---|
| 742,012 | 10/1903 | Decker | 312/242 |
| 1,120,955 | 12/1914 | Martin | 312/205 X |
| 2,074,780 | 3/1937 | Demcak | 312/205 |
| 2,915,960 | 12/1959 | McClellan, Jr. | 312/242 X |
| 3,067,822 | 12/1962 | Hattenhauer | 312/242 X |
| 3,620,404 | 11/1971 | Grasso | 312/242 X |
| 4,025,137 | 5/1977 | Wyler | 312/205 X |
| 4,076,350 | 2/1978 | Crist | 312/242 |
| 4,277,653 | 7/1981 | Pawelzick | 248/27.1 X |
| 4,408,811 | 10/1983 | Richardson et al. | 312/242 X |
| 4,560,214 | 12/1985 | Otema | 312/138 R X |

FOREIGN PATENT DOCUMENTS 1139968 11/1962 Fed. Rep. of Germany ..... 312/242

*Primary Examiner*—Joseph Falk

*Attorney, Agent, or Firm*—James P. Ryther

[57] ABSTRACT

A cabinet construction defining a back panel, side panels, a front panel, an opening defined by the front panel, and a door hinged to said front panel to close said opening and to permit access to the interior of the cabinet. The cabinet is receivable within a recess defined by a wall supporting the cabinet, and the front panel defines flanges adapted to extend over surfaces on the wall surrounding said recess. The side panels comprise first and second portions, one side panel portion being associated with said back panel and the other side panel portion being associated with said front panel. The side panel portions are telescopically arranged with respect to each other to permit adjustment of the relative positions of the side panel portions whereby the distance between the front and back panels can be varied to change the depth of the cabinet interior. The side panel portions can then be secured in a selected position with respect to each other.

19 Claims, 3 Drawing Sheets

CABINET CONSTRUCTION

BACKGROUND OF THE INVENTION

This invention relates to cabinet constructions of the type adapted for association with a wall. In particular, the cabinet construction is useful in connection with a wall which defines a recess for receiving at least a portion of the body of the cabinet.

The invention is particularly useful in connection with cabinets employed for supporting fire extinguishers. Cabinets of this type generally define a door which is formed of transparent material or which is at least partly transparent so that the fire extinguisher will be visible. The door may be of the type including a lock in which case the user will be able to break through the door to gain access to the fire extinguisher in an emergency. In other instances, the door will simply carry an easily operable latch to permit ready access to the extinguisher.

In certain building constructions, it is highly desirable to locate cabinets in wall recesses so that the cabinet will occupy a minimum of space, and will also be unobtrusive. For example, in commercial buildings, architects are always interested in maximizing useful space while minimizing the presence of unsightly objects.

Cabinet constructions must be designed with wall thicknesses in mind. Accordingly, it has been necessary for manufacturers of cabinet constructions to provide an inventory of various sizes to meet various construction needs. This situation is particularly true in the case of cabinets defined for holding fire extinguishers since various sizes of extinguishers are employed and cabinet inventories must be maintained to accommodate these size variations.

SUMMARY OF THE INVENTION

This invention relates to a cabinet construction uniquely suitable for placement in a wall defining a recess for holding the cabinet construction. The invention more specifically relates to a cabinet construction which is adjustable in size in order to be useful in association with walls of various thicknesses. The size variations possible with the cabinet construction also permit the elimination or at least reduction of the need for maintaining an inventory of different size cabinets.

The cabinet construction more specifically is characterized by a back panel, side panels, and a front panel. The front panel defines an opening to permit the attachment of a door for permitting access to the interior of the cabinet. The front panel also defines flanges extending outwardly relatively to the door and extending over surfaces of the wall which surround the recess.

The side panels comprise first and second portions with one side panel portion being associated with the back panel and with the other side panel portion being associated with the front panel. The side panel portions are telescopically arranged with respect to each other to permit adjustment of the relative positions of the side panel portions. This permits changes in the distance between the front and back panels thereby resulting in variations in the depth of the cabinet interior. Means are provided for securing the panel portions in a selected position with respect to each other so that the cabinet can be accommodated to wall recesses of various depths.

In situations where a wall thickness is insufficient for the desired depth of the cabinet interior, the invention provides that a portion of the cabinet will extend outwardly from the wall surface. The invention contemplates the use of a skirt adapted to be positioned between the front panel flanges and the adjacent wall surfaces to thereby provide a more attractive exposed exterior side surface.

The invention also contemplates a variety of means for latching of the cabinet door. Magnetic means or a friction catch may be utilized so that the cabinet door can simply be pulled open when access is necessary. In other instances, a lock may be associated with the door, but for applications requiring emergency access, a breakable door material is then included so that there will be no delay in gaining access.

DETAILED DESCRIPTION OF THE DRAWINGS

Figure 1:
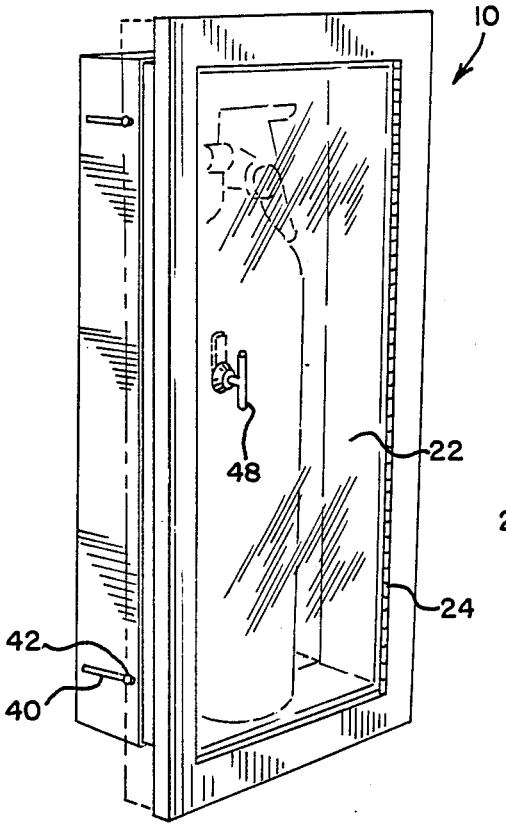
FIG. 1 is a perspective view of a cabinet construction characterized by the features of this invention.
Figure 2:
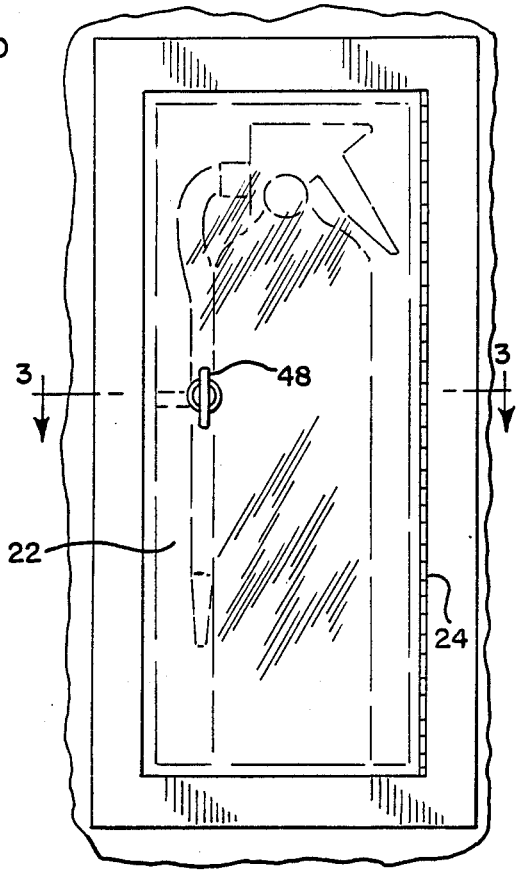
FIG. 2 is a front elevational view of the cabinet construction.
Figure 3:
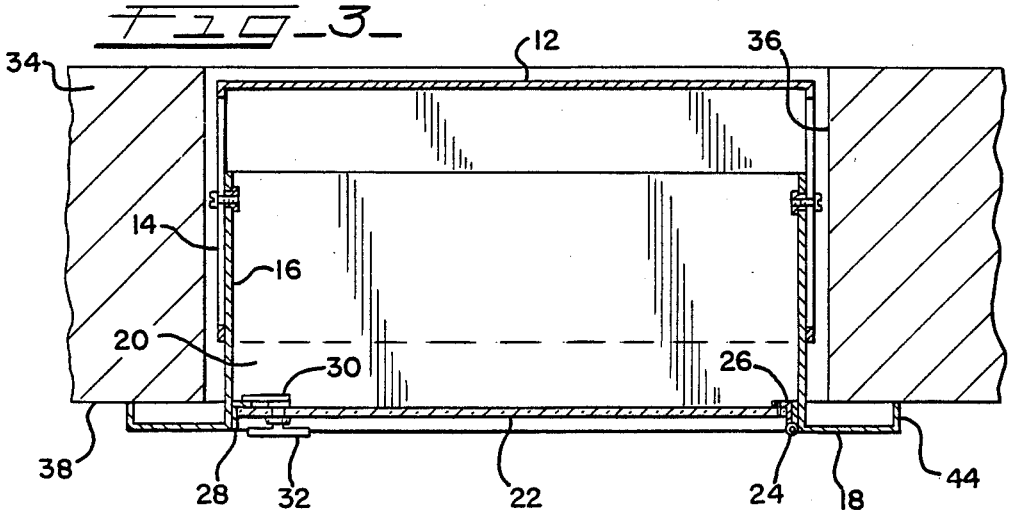
FIG. 3 is a cross-sectional view taken about the line 3—3 of FIG 2.
Figure 4:
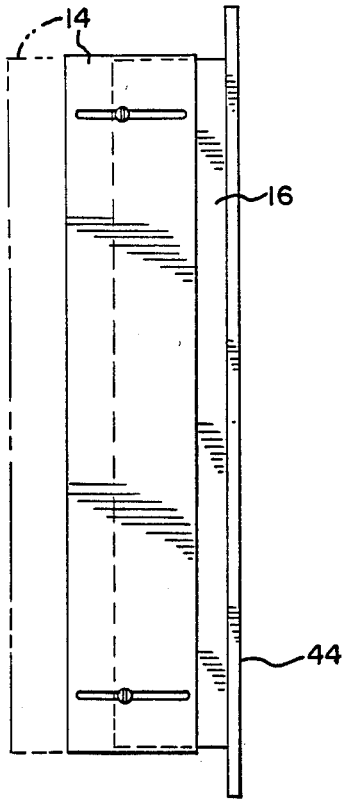
FIG. 4 is a side elevational view of the cabinet construction.
Figure 5:
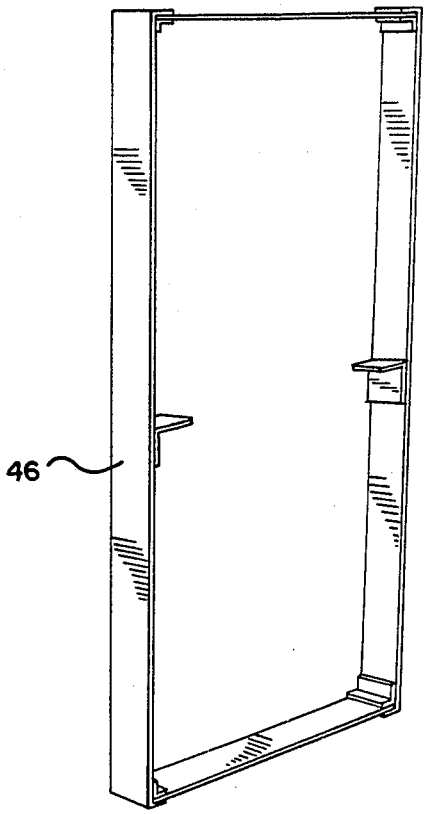
FIG. 5 is a perspective view of a rectangular skirt adapted for use in association with the cabinet construction.

The drawings illustrate a cabinet construction 10 including a back panel 12, side panels including a first portion 14 and a second portion 16, and a front panel 18. The back and side panels define a cabinet interior 20 and a door 22 permits access to this interior. In the embodiment shown in FIGS. 1 through 6, the door comprises a sheet of transparent material attached by means of hinge 24 to the front panel 18. This hinge includes angle member portion 26 which serves as an attaching means along one edge of the door. An additional angle member portion 28 is provided on the opposite side of the door 22 to serve as a stop for the door in the closed position.

A conventional latch 30 includes a catch engageable with one leg of angle member 28. Handle member 32 permits opening and closing of this latch for access to the interior of the cabinet.

The cabinet is adapted to be associated with wall 34, and a recess 36 is defined by this wall. The side wall portion 14 of the cabinet is telescopically arranged with respect to the side wall portion 16 so that the depth of the cabinet can be varied. In most applications, this variation will be dependent upon the thickness of wall 34 since it will usually be desirable when using cabinets of the type contemplated by this invention to achieve maximum depth for the cabinet while locating the cabinet substantially flush with the exposed surfaces 38 of wall 34.

Adjustability of the side wall portions 14 and 16 is achieved by means of slots 40 which receive nut and bolt fasteners 42. As will be appreciated, when the fasteners are loosened, the desired depth of the cabinet can be achieved, and when the fasteners are tightened, this depth will be maintained. Thus, the cabinet will be ready for installation in the recess 36 after adjusting the relative positions of the wall portions to achieve the desired depth.

As illustrated, the front wall portions 18 which comprise a flange construction include in-turned portions 44. In the arrangement shown in FIG. 3, these in-turned portions provide a frame arrangement permitting location of the cabinet construction substantially flush with the wall surface and also providing a relatively neat appearance. In a typical application, the cabinet construction will be formed of sheet metal with a baked enamel surface to provide the most desirable exterior appearance. Alternatively, stainless steel, another metal with a suitable appearance, plastic, or any other suitable material could be employed.

Figure 6:
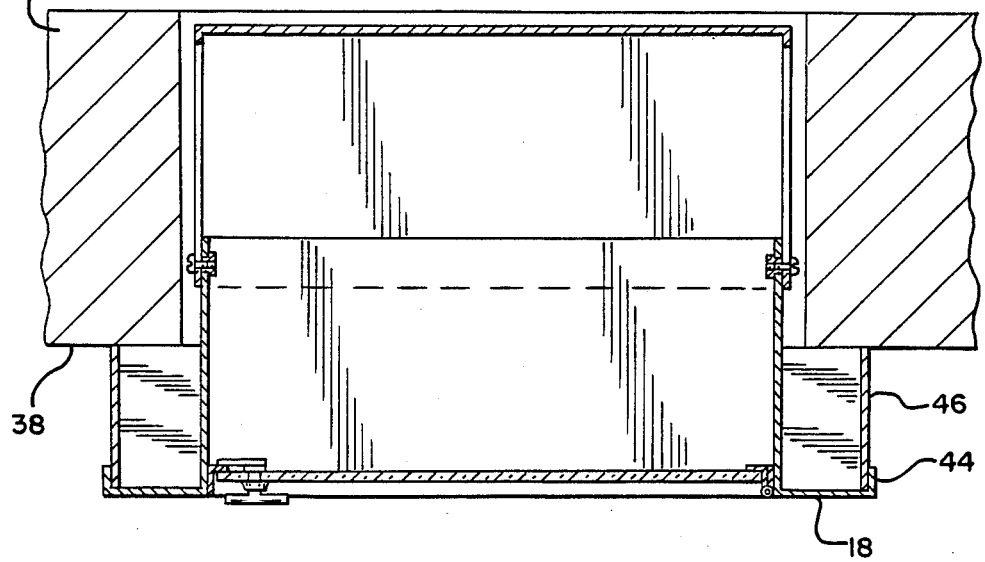
FIG. 6 is a cross-sectional view illustrating the adapted for use in association with a skirt.

FIG. 6 illustrates an arrangement wherein the wall 34 is of insufficient thickness to permit a cabinet of maximum depth to be located flush with the wall surface 38. In this instance, a skirt 46 is provided for extending between the wall surface and the flanges 18. As indicated, the skirt 46 is dimensioned to fit snugly within the confines of in-turned portions 44. By providing a corresponding enamel surface for the skirt 46, the exposed portion of the cabinet construction will maintain a desired appearance.

It will be appreciated that the adjustability of the side wall portions of the cabinet in combination with the skirt 46 also permits association of cabinet of even less depth with a wall of lesser thickness. Thus, the combination of the skirt and adjustable side wall portions substantially increases the versatility of the invention.

The cabinet construction of the invention can be packaged in a most efficient manner, that is, the parts can be readily disassembled to provide compactness. The skirt member 46 is particularly adapted to be made in separate parts for shipping purposes.

In the embodiment of the invention shown in FIGS. 1 through 6, the handle 32 is readily operated to release latch 30 for opening and closing of the door. Under certain conditions, it is desirable to provide a lock and key arrangement, for example, where vandalism is a potential problem. In that case, the door 22 may be formed of glass or of a breakable plastic so that a hammer or the like could be used for accessing the fire extinguisher in an emergency.

Figure 7:
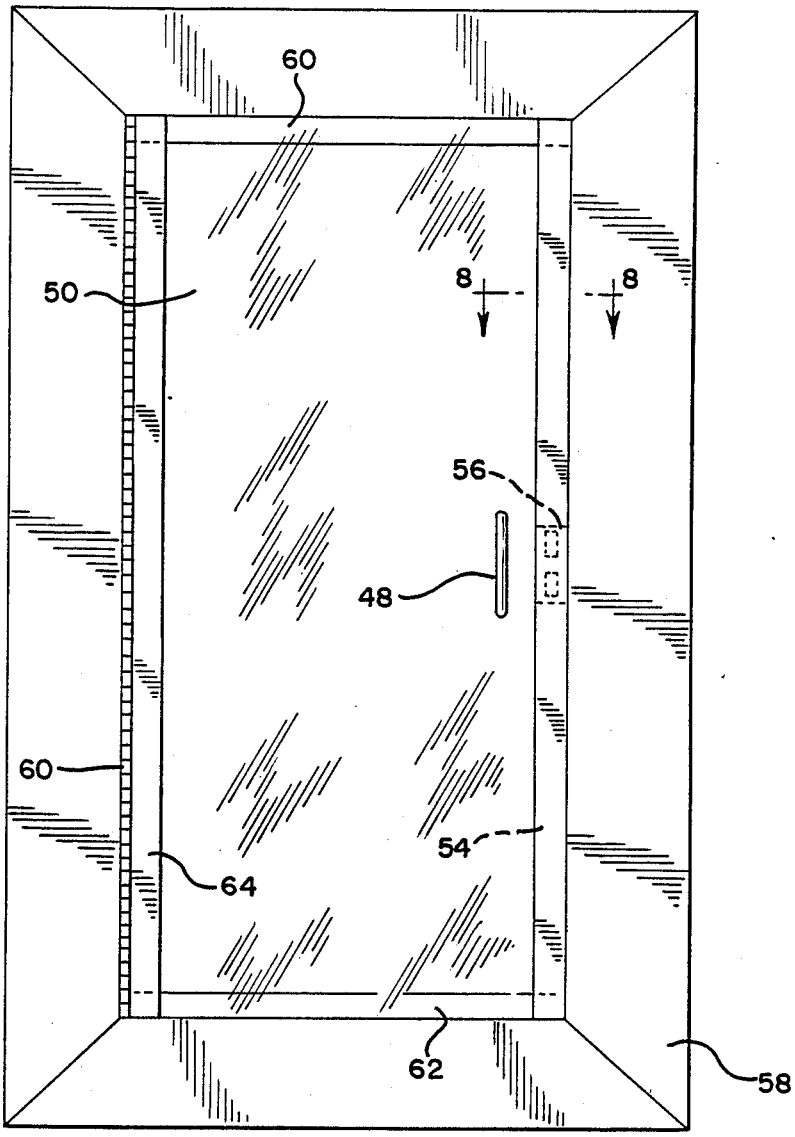
FIG. 7 is a front elevational view of a modified cabinet construction including a magnetic latch; and, FIG. 8 a fragmentary cross-sectional view taken about the line 8—8 of FIG. 7.
Figure 8:
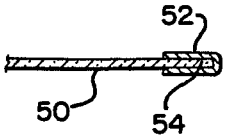

FIGS. 7 and 8 illustrate an alternative embodiment of the invention which includes a door handle 48 fixed in some fashion with respect to the door 50. A U-shaped metal strip 52 is cemented or otherwise secured along the edge 54 of the door, and this strip cooperates with magnet 56 which is attached to front panel 58. Hinge 60 attached along the opposite side of the front panel permits easy opening and closing of the door.

The arrangement shown in FIG. 7 includes U-shaped strips 62 along the upper and lower edges of the door 50, and the hinge 60 includes metal strip portion 64 which completes an exposed frame for the door. By utilizing an enamel finish for the frame, a quite attractive exterior appearance for the door can be achieved.

The arrangement of FIG. 7 also lends itself to the use of a simple friction catch in place of the magnetic closure illustrated. Thus, the door may be simply held in place by associating one or more grooved metal pieces with front wall 58 to hold the door in the closed position while permitting easy opening of the door.

It will be understood that various changes and modifications may be made in the subject matter described without departing from the spirit of the invention particularly as defined by the following claims.

That which is claimed is:

1. A cabinet construction receivable within a recess defined by a wall supporting the cabinet, said cabinet defining an enclosure formed by a back panel positioned at the rear of the recess, side panels, a front panel, an opening defined by the front panel, and a door hinged to said front panel to close said opening and to permit access to the interior of the cabinet, and said front panel defining flanges adapted to extend over surfaces on said wall surrounding said recess, said side panels comprising first and second portions, one side panel portion being associated with said back panel and the other side panel portion being associated with said front panel, said side panel portions being telescopically arranged with respect to each other, means permitting adjustment of the relative positions of said side panel portions whereby the distance between the front and back panels can be adjusted to vary the depth of the cabinet interior, and means for securing said side panel portions in a selected position with respect to each other.

2. A construction in accordance with claim 1 comprising a rectangular cabinet configuration.

3. A construction in accordance with claim 1 wherein said one side panel portion is formed integrally with said back panel, and said other side panel portion is formed integrally with said front panel.

4. A construction in accordance with claim 1 wherein one of said side panel portions defines at least one slot, and at least one fastener receivable in said slot, said fastener being movable in said slot during adjustment of the side panel portions, and said fastener serving to secure the side panel portions in said selected position.

5. A construction in accordance with claim 1 wherein said flanges include end portions inwardly bent in the direction of said wall surface.

6. A construction in accordance with claim 5 including a skirt positioned around the side panel portion associated with said front panel, said skirt being received within said inwardly bent end portions and extending to said wall surfaces to form an exposed exterior cabinet surface between said wall surfaces and said front panel.

7. A construction in accordance with claim 6 comprising a rectangular cabinet configuration and wherein said skirt defines a rectangular frame.

8. A construction in accordance with claim 1 wherein said door comprises a transparent sheet, hinge means attached to one side of said door opening, and fastening means securing one side edge of the sheet to said hinge means.

9. A construction in accordance with claim 8 including inset portions defined by the front panel along at least one edge of said opening, said inset portions providing top members for said door in its closed position.

10. A construction in accordance with claim 8 including a metal strip attached to another side edge of said sheet, and a magnetic closure means attached to said front panel, said strip being attracted to said closure means for holding the door in its closed position.

11. A construction in accordance with either of claims 9 or 10 including a strip fixed on the exposed face of said door along the side fastened to said hinge means to thereby hide said hinge means and associated fastening means from view.

12. A construction in accordance with claim 10 wherein said metal strip is U-shaped to provide a strip surface on the exposed face of said door 13. A fire extinguisher cabinet construction receivable within a recess defined by a wall supporting the cabinet, said cabinet defining an enclosure formed by a pack panel positioned at the rear of the recess, side panels, a front panel, an opening defined by the front panel, and a door hinged to said front panel to close said opening and to permit access to the interior of the cabinet, said door extending in substantially the same plane as the plane occupied by said front panel when the door is closed, and said front panel defining flanges adapted to extend over surfaces on said wall surrounding said recess, said side panels comprising first and second portions, one side panel portion being associated with said back panel and the other side panel portion being associated with said front panel, said side panel portions being telescopically arranged with respect to each other, means permitting adjustment of the relative positions of said side panel portions whereby the distance between the front and back panels can be adjusted to vary the depth of the cabinet interior and to thereby permit location of a fire extinguisher between said closed door and said back panel, and means for securing said side panel portions in a selected position with respect to each other.

14. A construction in accordance with claim 13 wherein said one side panel portion is formed integrally with said back panel, and said other side panel portion is formed integrally with said front panel.

15. A construction in accordance with claim 13 wherein one of said side panel portions defines at least one slot, and at least one fastener receivable in said slot, said fastener being movable in said slot during adjustment of the side panel portions, and said fastener serving to secure the side panel portions in said selected position.

16. A construction in accordance with claim 13 wherein said flanges includes end portions inwardly bent in the direction of said wall surface.

17. A construction in accordance with claim 16 including a skirt positioned around the side panel portion associated with said front panel, said skirt being received within said inwardly bent end portions and extending to said wall surfaces to form an exposed exterior cabinet surface between said wall surfaces and said front panel.

18. A cabinet construction receivable within a recess defined by a wall supporting the cabinet, said cabinet defining an enclosure formed by a back panel positioned at the rear of the recess, side panels, a front panel, an opening defined by the front panel, and a door hinged to said front panel to close said opening and to permit access to the interior of the cabinet, and said front panel defining flanges adapted to extend over surfaces on said wall surrounding said recess, said side panels comprising first and second portions, one side panel portion being associated with said back panel and the other side panel portion being associated with said front panel, said side panel portions being telescopically arranged with respect to each other, means permitting adjustment of the relative positions of said side panel portions whereby the distance between the front and back panels can be adjusted to vary the depth of the cabinet interior, said flanges including end portions inwardly bent in the direction of said wall surface, a skirt positioned around the side panel portion associated with said front panel, said skirt being received in close-fitting relationship within said inwardly bent end portions and extending to said wall surfaces to form an exposed exterior cabinet surface between said wall surfaces and said front panel, and means of securing said side panel portions in a selected position with respect to each other.

19. A fire extinguisher cabinet construction receivable within a recess defined by a wall supporting the cabinet, said cabinet defining an enclosure formed by a back panel positioned at the rear of the recess, side panels, a front panel, an opening defined by the front panel and a door hinged to said front panel to close said opening and to permit access to the interior of the cabinet, said door extending in substantially the same plane as the plane occupied by said front panel when the door is closed, and said front panel defining flanges adapted to extend over surfaces on said wall surrounding said recess, said side panels comprising first and second portions, one side panel portion being associated with said back panel and the other side panel portion being associated with said front panel, said side panel portions being telescopically arranged with respect to each other, means permitting adjustment of the relative positions of said side panel portions whereby the distance between the front and back panels can be adjusted to vary the depth of the cabinet interior and to thereby permit location of a fire extinguisher between said closed door and said back panel, said flanges including end portions inwardly bent in the direction of said wall surface, a skirt positioned around the side panel portion associated with said front panel, said skirt being received in close-fitting relationship within said inwardly bent end portions and extending to said wall surfaces to form an exposed exterior cabinet surface between said wall surfaces and said front panel, and means for securing said side panel portions in a selected position with respect to each other.

* * * * *